US005438174A

United States Patent [19]

Slade

[11] Patent Number: 5,438,174

[45] Date of Patent: Aug. 1, 1995

[54] VACUUM INTERRUPTER WITH A RADIAL MAGNETIC FIELD

[75] Inventor: Paul G. Slade, Wilkinsburg, Pa.

[73] Assignee: Eaton Corporation, Cleveland, Ohio

[21] Appl. No.: 155,355

[22] Filed: Nov. 22, 1993

[51] Int. Cl.[6] ..... H01H 33/66

[52] U.S. Cl. ..... 218/118

[58] Field of Search ..... 200/144 B, 275, 279

[56] References Cited

U.S. PATENT DOCUMENTS

| | | | |
|---|---|---|---|
| 3,612,795 | 10/1971 | Emmerich | 200/144 B |
| 3,851,203 | 11/1974 | Harris | 200/144 B X |
| 3,935,406 | 1/1976 | Murano et al. | 200/144 B |
| 3,946,179 | 3/1976 | Murano et al. | 200/144 B |
| 4,196,327 | 4/1980 | Kurosawa et al. | 200/144 B |
| 4,210,790 | 7/1980 | Kurosawa et al. | 200/144 B |
| 4,547,640 | 10/1985 | Kashiwagi et al. | 200/144 B |
| 4,553,007 | 11/1985 | Wayland | 200/144 B |
| 4,727,228 | 2/1988 | Hoene et al. | 200/144 B |

OTHER PUBLICATIONS

Paul G. Slade, "The Vacuum Interrupter Contact," Mar., 1984 IEEE Tran. Comp. Hybrids Package, vol. CHMT-7, pp. 25-32.

Schulman, M. B. and Bindas, J. A., "Evaluation of AC Axial Magnetic Fields Needed to Prevent Anode Spots in Vacuum Arcs Betweem Opening Contacts," Sep., 1993, Proc. 39th IEEE Conf. on Electric Contacts.

*Primary Examiner*—J. R. Scott

*Attorney, Agent, or Firm*—Martin J. Moran

[57] ABSTRACT

A vacuum interrupter with an enhanced radial magnetic field includes within a vacuum envelope a pair of confronting contacts that are relatively movable between an open circuit and a closed circuit position. The contacts, which can be the spiral-arm type or the slotted-cup type, are surrounded by a tubular metal vapor shield that is electrically isolated from at least one of the contacts in the open circuit position. Each contact is connected in series with a coil energized by the current in the interrupter and positioned proximate the non-confronting face of the contact, and with a current carrying terminal post extending outside the vacuum envelope. The current in the coils produces a radial magnetic field in the intercontact region that encourages a columnar arc between the contacts to move outward and attach to the vapor shield. This helps to promote a transition to a diffuse type of arc and allows for a more compact interrupter with greater interruption capability. The radial magnetic field can also be enhanced by using a contact design having elongated spiral-shaped arms that each extend more than 180° around the contact. The elongated spiral-arm contacts can be used in conjunction with the coil structure or used alone to produce the enhanced radial magnetic field. The vapor shield is fabricated of a thick layer of a Cu—Cr metal mixture, or of a high permeability material.

29 Claims, 5 Drawing Sheets

VACUUM INTERRUPTER WITH A RADIAL MAGNETIC FIELD

CROSS REFERENCE TO RELATED APPLICATIONS

The following commonly assigned applications all relate to vacuum interrupters: Ser. No. 08/155,376, filed on even date, entitled MULTIPLE ELECTRODE STRUCTURE FOR A VACUUM INTERRUPTER, by M. Bruce Schulman and Paul G. Slade, and Ser. No. 08/155,360, filed on even date, entitled VACUUM INTERRUPTER WITH A THICK, HIGH CONDUCTIVITY VAPOR SHIELD, by Paul. G. Slade.

BACKGROUND OF THE INVENTION

1. Technical Field

This invention relates to vacuum interrupters and, more particularly, to vacuum interrupters that provide a radial magnetic field in the contact region to encourage formation of a diffuse arc between the vacuum interrupter contacts and a surrounding metal vapor shield.

2. Description of the Prior Art

Vacuum interrupters are typically used, for instance, to reliably interrupt medium to high voltage ac currents of several thousands of amperes or more. They generally include a vacuum envelope enclosing a pair of facing contact electrodes, one of which is movable relative to the other from a closed circuit position to an open circuit position. Each contact is connected to a current-carrying stem, or terminal post, extending outside the vacuum envelope. Surrounding the contacts within the envelope is a tubular metal vapor condensing shield aligned concentrically with the contacts and terminal posts.

When the contacts are moved apart from the closed circuit position to the open position, an arc forms in the metal vapor evaporated from the contacts. The arcing continues between the contacts until the current is interrupted. Metal from the contacts that is vaporized by the arc condenses back onto the contacts and onto the vapor shield. The vapor shield thus serves to protect the insulating vacuum envelope from accumulating deposits of metals.

The designs of practical contact arrangements for commercial high-current vacuum interrupters have evolved over the past thirty years into two principal types, discussed in an article authored by this inventor. P. G. Slade, *The Vacuum Interrupter Contact,* IEEE Trans. on Components, Hybrids, and Mfg. Tech., Vol. CMHT-7, No. 1, p. 25–32, March 1984, herein included in this specification by reference. Each type of contact arrangement produces a magnetic field that helps to control the initially columnar arc and promote its transition to a diffuse mode before the current reaches zero in an a.c. circuit. In a first type of contact arrangement, an axial magnetic field generated by coils located behind the contacts forces the high-current arc to rapidly become diffuse and continuously distributed within the contact gap. In a second type of contact arrangement, using spiral-arm or slotted-cup contacts, a magnetic field self-generated by the current in the contacts is impressed perpendicular to the arc column in a direction which forces the arc to move rapidly around the circular periphery of the contact surface. A typical spiral-arm contact will have four arms each extending no more than 180° around the contact.

During high-current arcing with present spiral-arm or slotted-cup contact designs and a thick Cu—Cr vapor shield, the arc has been observed to do three things. First, it has been observed that the Lorentz force drives the arc along the peripheral edge of the contacts. Second, the arc column can be perturbed by a slot and attach from one contact to the vapor shield and back to the other contact and move across both the contacts and the shield. Third, the arc can attach to the contact and shield in a stationary, but somewhat diffuse arc. The vapor shield becomes, in effect, a third electrode in the second and third modes.

The third form of the vacuum arc is normally beneficial to the successful interruption of a high-current arc. When the vacuum arc burns between the contacts and shield, the magnetic field is along the line of current flow. This weak radial field causes the arc to become more diffuse and hence to deliver a smaller thermal load upon the contacts and the shield, thereby reducing the tendency to burn through the contacts or the shield. Reduction of burn-through allows more compact interrupter design with higher interruption capacity.

There is therefore a need for a vacuum interrupter that provides a greater radial magnetic field than that provided by prior art designs in order to encourage the promotion of the third form of high-current arcing.

SUMMARY OF THE INVENTION

The present invention for a vacuum interrupter includes a vacuum envelope, a pair of coaxially aligned contacts within the envelope that are relatively movable between a closed circuit position and an open circuit position, terminals electrically connected to each of the contacts and extending outside the vacuum envelope for carrying an electrical current when the contacts are in the closed circuit position, and a generally tubular metal vapor shield surrounding the contacts within the vapor shield. The contacts, which are preferably of the slotted cup or spiral-arm variety, each have a plurality of circumferentially spaced apart arms defining slots therebetween, each slot extending axially between the sides of the contact and extending inwardly into the contact from an opening at the peripheral edge.

According to the present invention, the vapor shield is preferably electrically isolated, or floating, from both contacts, or alternatively, electrically connected to only one of the contacts when they are in the open circuit position. A quadrupole magnetic field, generated by the current flowing through the interrupter circuit, includes a substantial radial component in the contact region to enhance the third mode of high-current arcing between the contacts and the shield. This is accomplished by two different means for producing a radial magnetic field in the contact region that can be used separately or in conjunction with each other.

According to one aspect of the invention, a first means for producing a radial magnetic field includes a coil, provided behind each contact, that is connected in series with the interrupter circuit, and thus energized by the current to be interrupted.

According to another aspect of the invention, a second means for producing a radial magnetic field is provided by a spiral-arm contact structure wherein each of the spiral-arms of each contact extends around the contact from an inner, or root position at a radius R to a tip that is displaced from the inner position by an angle $\phi$ that is greater than about 180°, and preferably about 360°. In this case, the current flowing through the contact arms themselves generates the enhanced radial magnetic field.

According to another aspect of this invention, the first and second means for producing a radial magnetic field are combined in the same vacuum interrupter.

According to a further aspect of the invention, the vapor shield is a Cu—Cr metal mixture having a thickness of at least about 0.125 inches in order to be able to absorb the energy input from attachment of the high-current arc to the shield.

According to yet another aspect of the invention, the vapor shield is fabricated from a material having a magnetic permeability that is greater than that of a Cu—Cr mixture having between 40% and 80% Cu by weight. The material can include Fe—Ni, or alloys thereof, or a mixture of Fe and Cu, in order to enhance attachment of magnetic field lines to the vapor shield.

It is an object of this invention to provide a vacuum interrupter that has a high current interruption capacity.

It is another object of this invention to provide a vacuum interrupter that is compact.

It is another object of this invention to provide a vacuum interrupter having a contact design with spiral-shaped arms that enhances arc transfer to the vapor shield.

It is another object of this invention to provide a vacuum interrupter that promotes the third mode of arcing.

It is another object of this invention to provide a compact, durable vacuum interrupter that more efficiently uses the current to be interrupted to create a radial magnetic field in the inter-contact region.

These and other objects of the present invention will be more fully understood from the following description of the invention with reference to the illustrations appended hereto.

DETAILED DESCRIPTION OF THE INVENTION

The present invention provides an enhanced radial magnetic field in the contact region of a vacuum interrupter by more efficiently using the current in the circuit to be interrupted to produce the field. The enhanced radial field encourages a columnar arc that is initially located between the interrupter contacts to attach to a vapor shield surrounding the contacts. The arc then becomes more diffuse and is interrupted more quickly than if the arc had not attached to the shield. This is accomplished with two complementary means, the first of which incorporates field coils into the interrupter circuit, and the second of which uses the contact design to increase the field. The two means can be used together in the same interrupter, or they can each be used alone.

Figure 1:
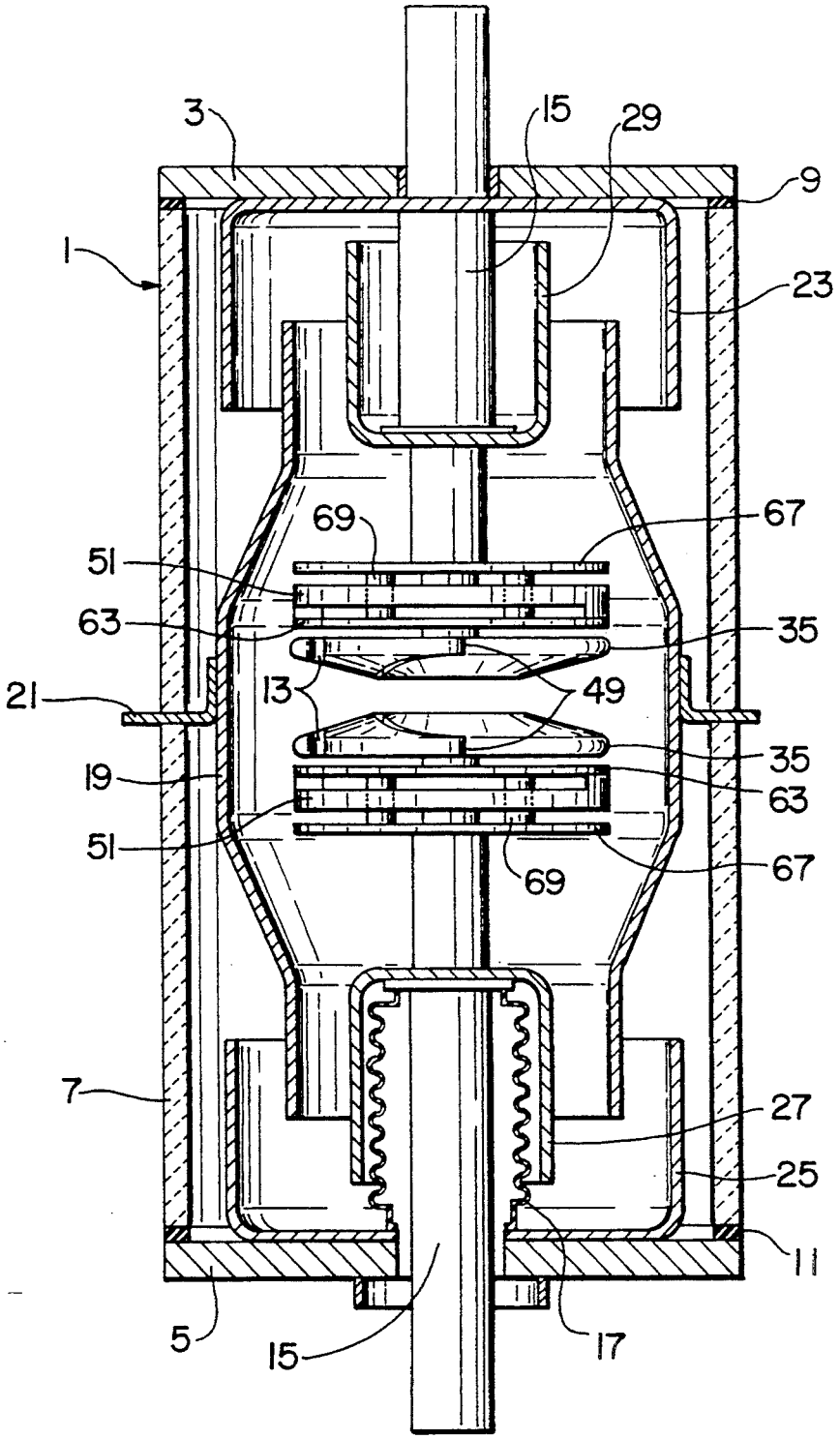
FIG. 1 is a longitudinal section view through a preferred embodiment of the vacuum interrupter of this invention.

A preferred embodiment of a vacuum interrupter of this invention that incorporates field coils in the interrupter circuit is shown in FIG. 1. A vacuum envelope 1 enclosing the internal components includes spaced apart end caps 3, 5 and a tubular, insulating casing 7 joined together by metal-to-insulation vacuum seals 9, 11. The envelope 1 is evacuated to a pressure of $\sim 10^{-6}$ Torr. The vacuum interrupter has a pair of current-carrying contact assemblies aligned coaxially along the longitudinal axis of the vacuum envelope 1. One assembly is relatively movable with respect to the other from a closed circuit position (not shown) to an open circuit position. Because each contact assembly mirrors the other, it will be understood that the reference characters used in the following description refer to similar components of each assembly.

Each contact assembly includes a disk-shaped electrical contact 13 that confronts the other contact within the vacuum envelope 1. Each contact 13 is electrically and mechanically linked to an electrical terminal, or stem 15, that extends outside the envelope 1 through an end cap 3, 5 and connects to a high-current a.c. circuit (not shown). A bellows assembly 17 incorporated into one of the terminals 15 allows the contacts 13 to be relatively movable between the open circuit position and a closed circuit position. Surrounding the contacts 13 is a generally cylindrical, metal vapor condensing shield 19 that is electrically isolated from at least one of the contacts. In this embodiment, a central support 21 connected to the insulating casing 7 supports the vapor shield 19 such that it is electrically isolated, i.e. floating, from both of the contacts 13. Although a floating shield 19 is shown in FIG. 1, the shield can also be electrically connected to one or the other of the contacts in the open circuit position. End shields 23, 25 protect the end caps 3, 5. A bellows shield 27 further protects the bellows assembly 17, and a similar shield 29 protects the other terminal.

Figure 2:
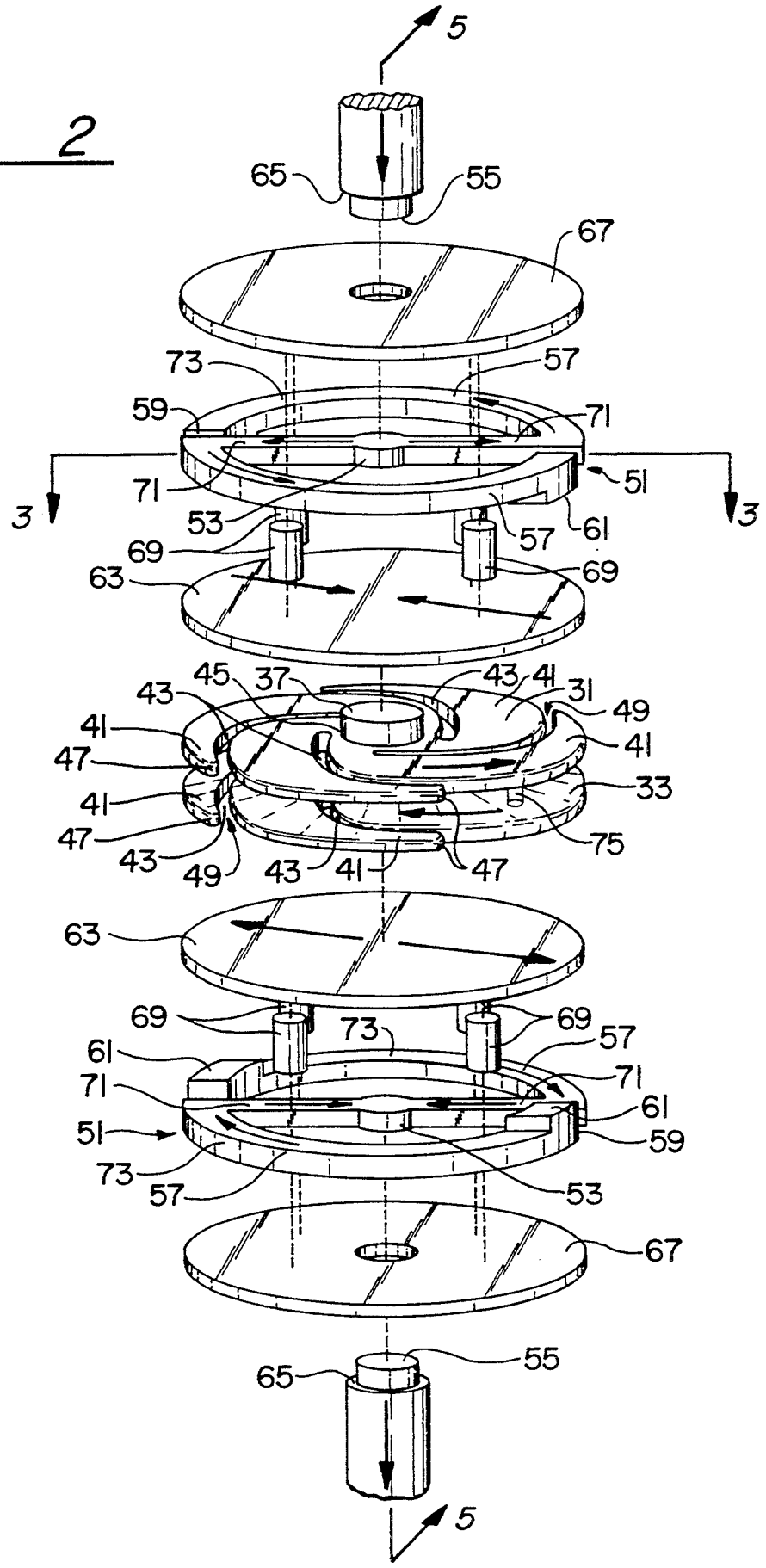
FIG. 2 is an exploded perspective view of the current-carrying components of the vacuum interrupter of FIG. 1. Arrows indicate the direction of current flow for one polarity of the a.c. current.

The contacts 13 in this preferred embodiment are each of the spiral-shaped arm variety, although an arrangement using slotted-cup contacts that are well known in the art can also be used. Referring now also to FIG. 2., which shows an exploded perspective view of the current-carrying elements of the interrupter of FIG. 1., and to FIG. 5, which shows a longitudinal cross-section of the current-carrying elements and the shield of FIGS. 1 and 2, each contact 13 has a first side 31 spaced apart from a second side 33 and a peripheral edge 35 therebetween. The first side 31 of each contact 13 is directly connected on axis to a cylindrical contact button 37. The second side 33 has an annular contacting face 39 that engages the contacting face of the other contact in the closed circuit position. Each contact in this embodiment has four circumferentially spaced apart, spiral-shaped arms 41 that define slots 43 therebetween, each slot extending axially between the first and second sides 31, 33 an inwardly into the contact 13 from an opening 49 at the peripheral edge 35. Each spiral-shaped arm 41 extends from an inner position 45 to a tip 47 at the peripheral edge 35 that is angularly displaced from the inner position 45. The angular displacement $\phi$ in the embodiment shown in FIG. 2 is no more than 180° . In the preferred embodiment shown in FIGS. 1, 2, 3 and 5, coil means to produce a radial magnetic field in the contact region is positioned behind each of the contacts 13. The coil means a current-carrying coil 51 connected in series between the terminals 15 and the contacts 13 and thus energized by the current to be interrupted. In this preferred embodiment, each coil 51 includes a centrally located, cylindrical coil post 53 that is in contact with a cylindrical terminal end 55. Extending from the coil post 53 are two coil arms 57 spaced 180° apart. Each coil arm 57 extends to a radius that is preferably about the radius of the contacts 13 and extends circumferentially therefrom to a coil arm end 59 close to the other coil arm. Conducting means electrically connects the coil arm end 59 to the contact 13. Each coil arm end 59 has an axially extending coil arm contact 61 for making electrical connection with a connecting member, preferably conducting first plate 63. The conducting first plate 63, in turn, connects to the contact button 37, completing the electrical connection between the terminal 15 and the contact 13.

The terminals 15, coils 51, conducting first plates 63 and contacts 13 should be fabricated of materials having good conductivity. A Cu—Cr metal mixture, well known in the prior art, can be used for the contacts. The other components can be fabricated of a metal, such as copper, and dimensioned such that they are capable of carrying high a.c. currents for long periods of time without significant resistive heating. The choice of materials and dimensions will, of course, be dependent upon the circuitry in which the interrupter will be used.

Figure 3:
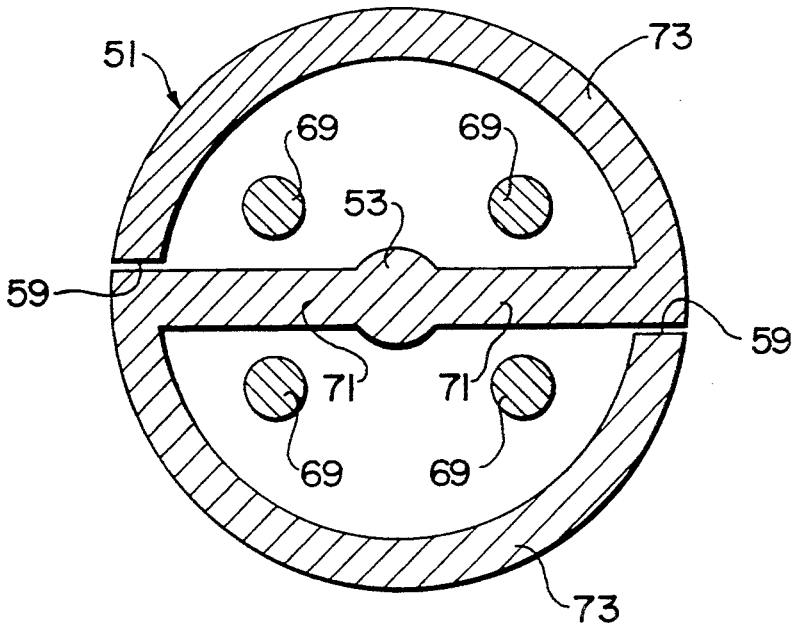
FIG. 3 is a cross-sectional view through line 3—3 of FIG. 1 showing the arrangement of support pins with respect to a field coil.

A support structure is provided for each of the coils 51 in the preferred embodiment shown in the figures. Each terminal 15 has an annular shoulder 65 set back from the terminal end 55. Positioned against the shoulder 65 and spaced apart from the coil 51 is an annular second plate 67 made of a material that has a conductivity that is significantly less than that of the coil material, such as stainless steel or a ceramic. Referring now also to FIG. 3, a plurality of support posts 69, are positioned between the annular plate 67 and the conducting plate 63. In this preferred embodiment, four support posts 69 are used. The support posts 69 are also made of a low conductivity material, such as stainless steel or a ceramic.

The exploded view shown in FIG. 2 indicates with arrows the current path through the contact assemblies. Current flows into the interrupter through one of the terminals 15, flows into the connecting coil post 53 and radiates out through the radially extending portions 71 of the coil arms 57. The current circulates though the circumferentially extending portions 73 of the coil arms 57 and onto the conducting first plate 63 via the coil arm contacts 61. The current then travels inward to the contact button 37, and outward therefrom to the contacting face 39 of the contact 13. When the contacts 13 are in the closed circuit position (not shown), the current flows directly into the contacting face of the confronting contact and traces a path through the other contact assembly and out of the interrupter in reverse order of that described above.

When the contacts 13 are separated, an arc 75 forms between the contacts in the metal vapor evaporated from the contacts. The current through the coil 51 and the contacts 13 generates a magnetic field that interacts with the arc 75, driving the arc 75 around the contacts 13 and outward. The current through the circumferentially extending portions 73 of the coil arms 57 enhances the radial magnetic field in the contact region and helps to drive the arc 75 outward to the tip of a spiral-shaped arm 41. The arc 75 may then be perturbed by a slot 43 and cross over from one contact to the vapor shield 19 and back to the confronting contact. Current flowing through the radially extending portions 73 and flowing about radially through the conducting plate 63 produce magnetic fields that largely cancel. The non-cancelling lower order effects can typically be ignored.

Figure 5:
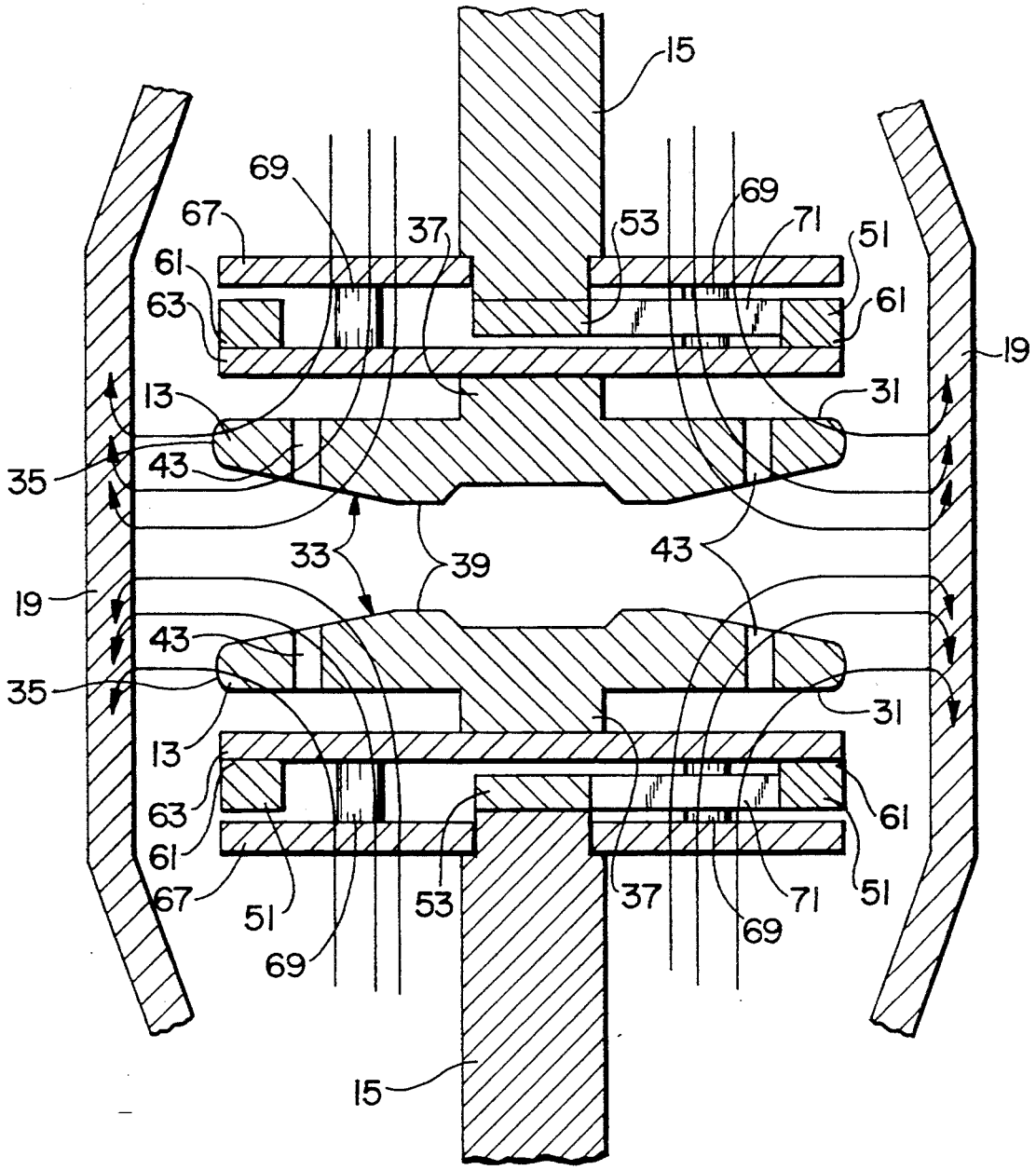
FIG. 5 is longitudinal cross-sectional view taken through line 5—5 of FIG. 2 and a surrounding vapor shield. Lines with arrows indicate the typical arrangement of magnetic field lines when a high-permeability vapor shield is used.

A sectional illustration of the contact assemblies and the vapor shield 19 showing a quadrupole field line pattern produced by a coil structure of this invention is shown in FIG. 5. The fields produced by each of the coils 51 is directed oppositely in the axial direction, but additively in a radial direction. In this embodiment, a high permeability shield material is used to enhance attachment of the field lines to the shield.

While for convenience and simplicity of disclosure herein reference has been made to a preferred embodiment of a coil and support structure, it will be appreciated that the invention is not so limited to that particular design. Alternative embodiments of the coil may have a single arm rather than two, may have multiple windings, or have different means electrically connecting the coil to the terminal and to the contact. The design of a support structure will necessarily be dictated to a large degree by the choice of a coil design.

Figure 4:
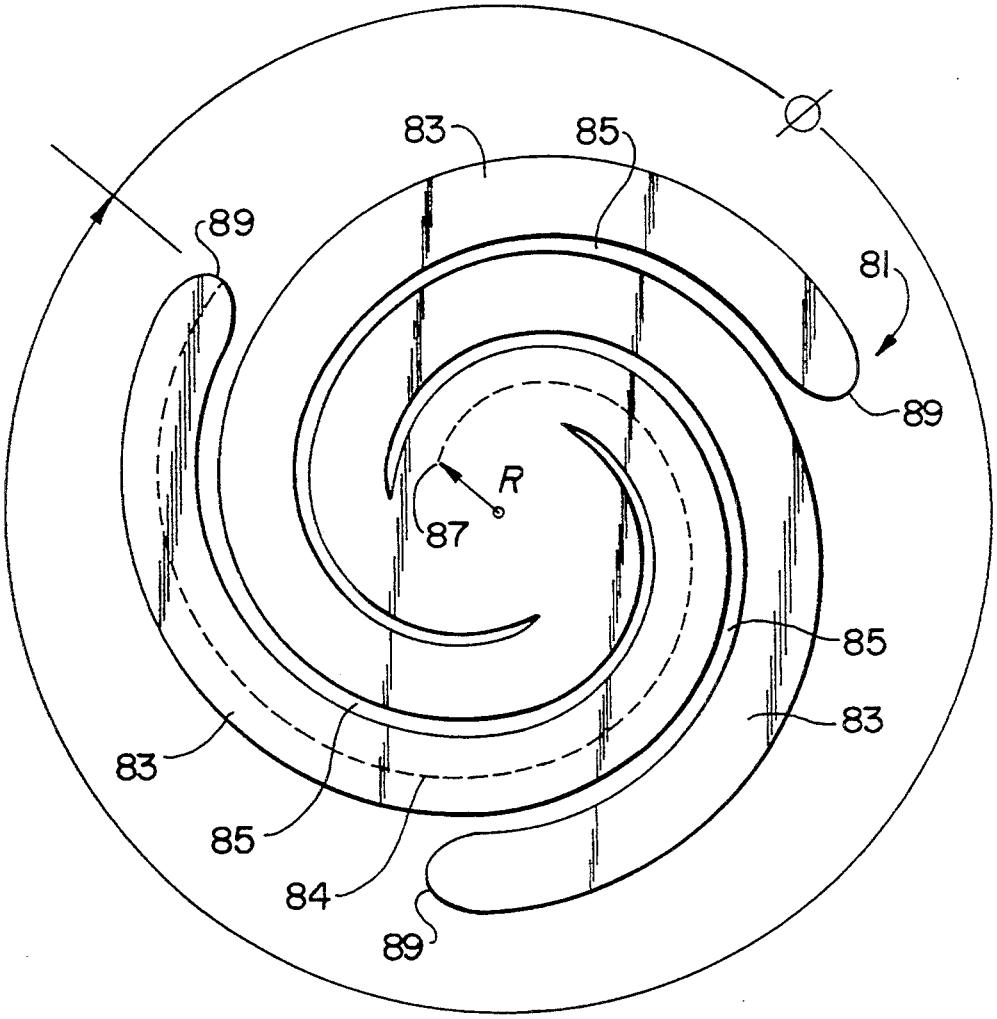
FIG. 4 is a plan view of a preferred embodiment of a spiral-arm contact of this invention.

Referring now to FIG. 4, a preferred embodiment of a spiral-arm contact of this invention that can, by itself, enhance the radial field is shown in plan view. The contact 81 has three spiral-shaped arms 83 defining slots 85. As illustrated for one of the arms 83, a midline 84 of each arm 83 extends from about an inner, or root position 87 located between adjacent slots 85 at a first radius R to a tip 89 that is angularly displaced from the inner position by an angle $\phi$ that is greater than 180° and preferably about 360°. This structure enhances the circumferential current flow in the contacts, and therefore enhances the radial magnetic field in the contact region. It will be understood that a different number of spiral-arms, such as 2, 4, or 5, can also be used. A field coil, as described above, can be used in conjunction with this type of spiral-arm contact to further enhance the radial magnetic field.

It is important to provide a thick vapor shield for a vacuum interrupter that incorporates the field coil 51 or the spiral-arm contact 81 of this invention. The enhanced radial fields produced by these features will increase the probability that the columnar arc 75 attaches to the vapor shield 19. The vapor shield 19 therefore must be thick in order to be able to absorb and dissipate the additional energy input from the columnar arc 75 before it undergoes a transition to the diffuse mode. A vapor shield 0.125 inches thick and made of a Cu—Cr metal mixture having a copper content that is in a range between about 40% and about 80% by weight, and preferably about 75%, is appropriate for use in a vacuum interrupter of this invention, although other mixtures or materials known in the art may also be used. The vapor shield 19 can also be made of a high-permeability material, such as iron, nickel, alloys of iron or nickel, or a Ni—Fe metal mixture, to enhance attachment of the field lines, and thus the arc, to the shield, as illustrated in FIG. 5.

Those skilled in the art will readily see the benefits of this invention. The extended spiral-shaped arms in the contacts will encourage the constricted vacuum arc to rotate around the contact periphery. The field coil behind the contact will provide some additional assistance. The spiral-shaped arm contact design and the coil arrangement will also produce a radial magnetic field that helps drive the arc to the vapor shield. When the vacuum arc attaches itself from the contact to the vapor shield and back again, the imposed radial field will also more effectively force the vacuum arc to go into the diffuse mode. Hence, the energy input per unit area into the shield will be distributed along a band surrounding the whole contact and the energy into the contacts will be distributed along the entire peripheral edge. The thick shield can be made from a Cu—Cr metal mixture, or a high-permeability material, such as Fe, Ni, alloys thereof, or a metal mixture of Fe and Ni, in order to confine the field in the vapor shield. By more effectively distributing the arc energy to three electrodes instead of two, a more durable, more compact interrupter with higher interruption capability will result.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents.

I claim:

1. A vacuum interrupter, comprising:

a vacuum envelope;

a pair of coaxially aligned contact assemblies that are relatively movable between an open circuit position and a closed circuit position, each coaxially aligned contact assembly comprising:

a single contact located within the vacuum envelope, comprising a first side, a peripheral edge between the first side and a second side, a contacting face on the second side confronting the other contact and engageable with the other contact in the closed circuit position, and a plurality of circumferentially spaced apart contact arms defining slots therebetween;

a terminal for connecting the contact assembly to an a.c. circuit outside the vacuum envelope and having a terminal end electrically coupled to the contact and located inside the vacuum envelope; and coil means energized by the a.c. circuit within the vacuum envelope for cooperatively producing, in conjunction with the coil means of the other contact assembly, a quadrupole magnetic field including a substantial radial component between the contacts, the coil means comprising a coil made of a first conducting material; and a generally tubular, electrically conducting metal vapor shield positioned within the vacuum envelope, surrounding the contacts and electrically isolated from at least one of the contact assemblies in the open circuit position, wherein the radial component of the quadrupole pole magnetic field enhances a probability of forming a diffuse arc between one of the contacts and the vapor shield.

2. The vacuum interrupter of claim 1, wherein each coil comprises a coil post connected to the terminal end, a coil arm extending radially from the coil post and extending circumferentially therefrom to a coil arm end, and wherein the coil means further comprises conducting means for electrically connecting the coil end to the first side of the contact.

3. The vacuum interrupter of claim 2, wherein each contact assembly is characterized in that the conducting means comprises a contact button extending axially from the center of the first side of the contact, a coil arm contact extending axially from the coil arm end, and a connecting member extending between the coil arm contact and the contact button for carrying an electrical current therebetween.

4. The vacuum interrupter of claim 3, wherein each contact assembly is characterized in that the connecting member is a conducting first plate, and wherein each contact assembly further comprises support means, the support means comprising a second plate having a central opening through which the terminal end extends and fabricated of a material that is significantly less conducting than the first conducting material, and a plurality of support posts extending between the second plate and the first plate and fabricated of a material that is significantly less conducting than the first conducting material.

5. The vacuum interrupter of claim 1, characterized in that each of the contact arms is substantially spiral-shaped and in that each arm extends from a root position about on a midline of the arm at a radius R to a tip at the peripheral edge angularly displaced from the root position by a polar angle $\phi$ that is greater than 180°.

6. The vacuum interrupter of claim 5, characterized in that $\phi$ is about 360°.

7. The vacuum interrupter of claim 6, characterized in that each contact has three spiral-shaped arms.

8. The vacuum interrupter of claim 1, characterized in that the vapor shield is at least ⅛ inch thick such that the vapor shield can absorb and dissipate energy from the diffuse arc without significant damage.

9. The vacuum interrupter of claim 8, characterized in that the vapor shield is fabricated from a metal mixture comprising copper and chromium.

10. The vacuum interrupter of claim 9, characterized in that the metal mixture comprises between about 40% and about 80% by weight copper.

11. The vacuum interrupter of claim 8, characterized in that the vapor shield adjacent to the contacts is fabricated from a shield material having a greater permeability than a Cu—Cr metal mixture having a copper content that is in a range of between about 40% and 80% by weight.

12. The vacuum interrupter of claim 11, characterized in that the shield material is selected from the group consisting of iron, nickel, an alloy of nickel, an alloy of iron and a Ni—Fe metal mixture.

13. A vacuum interrupter, comprising:

a vacuum envelope;

a pair of coaxially aligned, substantially disk-shaped contacts within the vacuum envelope that are relatively movable between a closed circuit position and an open circuit position, each contact comprising a contacting face confronting the other contact and engageable with the other contact in the closed circuit position and a plurality of substantially spiral-shaped arms defining slots therebetween, each spiral-shaped arm extending from a root position about on a midline of that spiral-shaped arm at a first radius to a tip at a peripheral edge of the contact angularly displaced from the root position by a polar angle $\phi$ that is greater than 180°;

terminal means connected to each contact for carrying an electrical current in the closed circuit position; and a generally tubular vapor shield surrounding the contacts within the vacuum envelope and electrically isolated from at least one of the contacts in the open circuit position, wherein the contacts are aligned such that a quadrupole magnetic field having a significant radial component between the contacts is generated by the electrical current in the contacts when the contacts are separated and an arc is formed between the contacts.

14. The vacuum interrupter of claim 13, wherein $\phi$ is about 360°.

15. The vacuum interrupter of claim 14, characterized in that each contact has at least three spiral-shaped arms.

16. The vacuum interrupter of claim 13, characterized in that the vapor shield is at least ⅛ inch thick such that the vapor shield can absorb and dissipate energy from an arc between at least one of the contacts and the vapor shield without significant damage.

17. The vacuum interrupter of claim 16, characterized in that the vapor shield is fabricated from a metal mixture comprising copper and chromium.

18. The vacuum interrupter of claim 17, characterized in that the metal mixture comprises between about 40% and about 80% by weight copper.

19. The vacuum interrupter of claim 16, characterized in that the vapor shield is fabricated from a shield material having a higher permeability than a Cu—Cr metal mixture having a composition that is about 75% by weight Cu and about 25% by weight Cr.

20. The vacuum interrupter of claim 19, characterized in that the shield material is selected from the group consisting of iron and nickel.

21. The vacuum interrupter of claim 19, characterized in that the shield material includes at least one of the materials selected from the group consisting of iron and nickel.

22. A vacuum interrupter, comprising:

a vacuum envelope;

a pair of coaxially aligned contact assemblies that are relatively movable between open and closed circuit positions, each coaxially aligned contact assembly comprising:

a contact within the vacuum envelope, characterized by spaced apart first and second sides and a peripheral edge therebetween, a contacting face on the second side confronting the other contact and engageable with the other contact in the closed circuit position, a cylindrical contact button extending coaxially from the first side, and a plurality of circumferentially spaced, spiral-shaped arms defining slots therebetween, each spiral-shaped arm extending from a root position about on a midline of that spiral-shaped arm at a first radius to a tip at the peripheral edge displaced from the root position by a polar angle $\phi$;

a substantially cylindrical terminal for connecting the contact assembly to an a.c. circuit, comprising a terminal end located within the vacuum envelope and an annular shoulder; and coil means for generating a radial magnetic field between the contacts comprising:

a coil connected in series between the terminal and the contact and made of a first conducting material, comprising a cylindrical coil post abutting the terminal end, and a pair of coil arms about 180° apart, each coil arm having a radially extending portion extending from the coil post to a second radius, a circumferentially extending portion extending from the second radius to a coil arm end at a position proximate to and spaced apart from the other coil arm and a coil arm contact extending axially towards the contact from the coil arm end;

a conducting first plate made from a second conducting material and positioned between the contact button and the coil arm contacts and providing electrical contact therebetween;

an annular second plate abutting the shoulder and fabricated from a material having a conductivity that is significantly less than that of the first and second conducting materials; and a plurality of support posts, made from a material having a conductivity significantly less than that of the first and second conducting materials, extending between the annular plate and the conducting plate; and a generally tubular vapor shield at least about e,fra 1/8× inch thick surrounding the contacts within the vacuum shield and electrically isolated from at least one of the contacts in the open circuit position.

23. The vacuum interrupter of claim 22, characterized in that $\phi$ is greater than 180°.

24. The vacuum interrupter of claim 23, characterized in that $\phi$ is about 360°.

25. The vacuum interrupter of claim 24, characterized in that each contact has three spiral-shaped arms.

26. The vacuum interrupter of claim 22, characterized in that the vapor shield is fabricated from a material that is selected from the group consisting of iron and nickel.

27. The vacuum interrupter of claim 22, characterized in that the vapor shield is fabricated from a Cu—Cr metal mixture having about 75% by weight Cu and about 25% by weight Cr.

28. The vacuum interrupter of claim 22, characterized in that the vapor shield is fabricated from material that includes at least one of the materials selected from the group consisting of iron and nickel.

29. The vacuum interrupter of claim 11, characterized in that the vapor shield is fabricated from a material that includes at least one of the materials selected from the group consisting of iron and nickel.

* * * * *